United States Patent [19]

Huber et al.

[11] Patent Number: 4,730,359

[45] Date of Patent: Mar. 15, 1988

[54] DEVICE FOR CONTROLLING THE SPACING OF THE PLATES ON A BRIDGING ARRANGEMENT FOR EXPANSION JOINTS IN BRIDGES OR THE LIKE

[75] Inventors: R. Huber, Bülach, Switzerland; W. Koster, Forsbach, Fed. Rep. of Germany

[73] Assignee: Kober AG, Glarus, Switzerland

[21] Appl. No.: 650,836

[22] Filed: Sep. 17, 1984

[30] Foreign Application Priority Data

Sep. 20, 1983 [DE] Fed. Rep. of Germany ..... 3333880

[51] Int. Cl.[4] ..... E01D 19/06

[52] U.S. Cl. ..... 14/16.5; 404/68; 404/67

[58] Field of Search ..... 14/16.5; 404/56, 67, 404/68, 69; 52/396, 573, 698

[56] References Cited

U.S. PATENT DOCUMENTS 3,854,159 12/1974 McLean et al. ..... 14/16.5
3,974,614 8/1976 Strong ..... 14/16.5
4,050,207 9/1977 Bertschmann et al. ..... 404/68

*Primary Examiner*—James A. Leppink
*Assistant Examiner*—Matthew Smith
*Attorney, Agent, or Firm*—George E. Kersey

[57] ABSTRACT

A device for controlling the spacing of the plates on a bridging arrangement for expansion joints in bridges or the like, in which device one or more plates run parallel between edge beams defining the expansion joint and are mounted on cross-members bridging the expansion joint. The plate is coupled to the two edge beams, or each plate is coupled to an edge beam and an adjacent plate or to two adjacent plates, by means of resilient members arranged to act in shear. Each resilient member is secured by one end to an edge beam or a plate and by the other end to a connector that is resistent to bending. Each connector connects the resilient members of an edge beam and a plate or of two plates to one another. All the plates are connected to one another and to the edge beams by one or more continuous control chains comprising shear springs and connectors.

7 Claims, 6 Drawing Figures

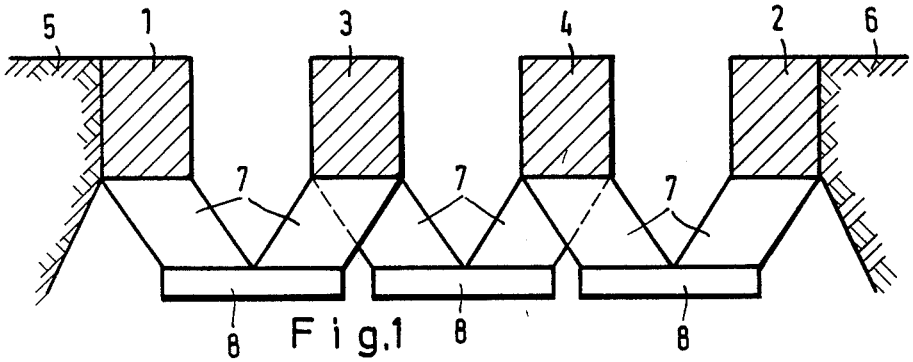
Fig.1
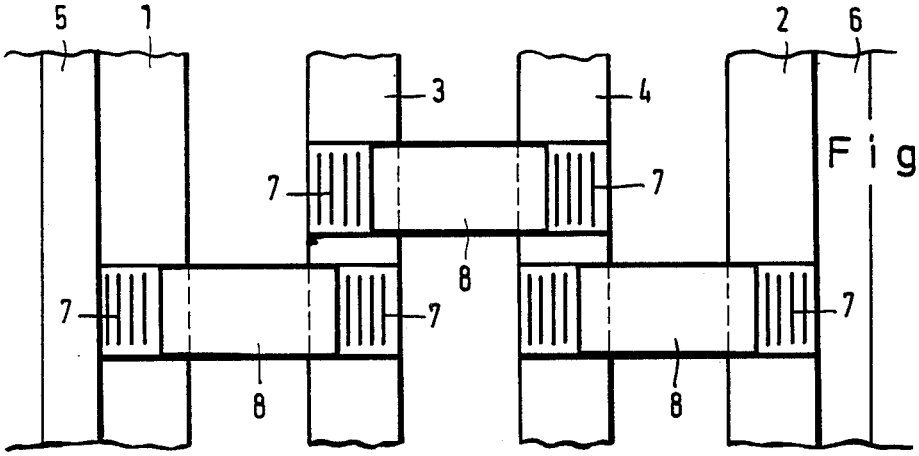
Fig.2
Fig.3
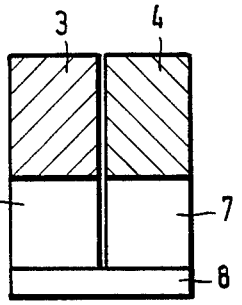
Fig.4
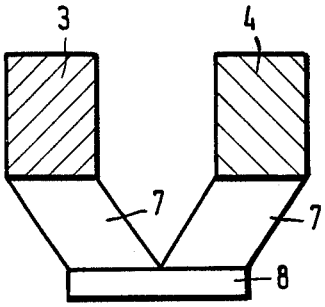
Fig.5
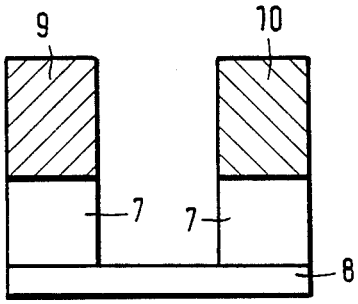
Fig.6
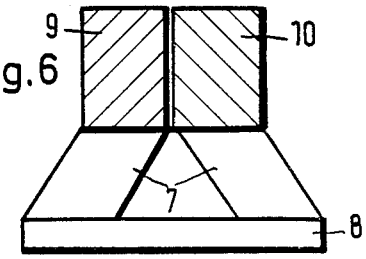

DEVICE FOR CONTROLLING THE SPACING OF THE PLATES ON A BRIDGING ARRANGEMENT FOR EXPANSION JOINTS IN BRIDGES OR THE LIKE

BACKGROUND TO THE INVENTION

The invention relates to a device for controlling the spacing of the plates on a bridging arrangement for expansion joints in bridges or the like, which arrangement has one or more plates running parallel between the edge beams that define the expansion joint and mounted on cross-members bridging the expansion joint.

There are, in practice, numerous types of control devices for bridging arrangements of the type mentioned. Owing to their noiseless functioning, those control devices having elastomeric control elements which flexibly support adjacent plates with respect to one another and the outer plates with respect to the edge beams have become widely used.

In one previously proposed control device of the type mentioned at the beginning (see DE-OS No. 30 17 048), there are used as control elements shear-deformable elastomeric blocks which at the same time form load-transmitting bearing parts between the plates and the cross-members arranged underneath them. In such constructions, the control device is therefore part of the load-supporting system, and all the components of the bridging arrangement must therefore be a plurality of connectors that are resistant to bending; a plurality of resilient members, each secured at one end to a said edge beam or to a said plate and at the other end to a said connector; each connector connecting said resilient members secured to one said edge beam and to a said plate or to two said plates to one another in such a manner that said plate is coupled to said two edge beams or each said plate is coupled to a said edge beam and to an adjacent said plate or to two adjacent said plates, by means of a said connector through said resilient members, said resilient members deforming resiliently in shear in response to changes in the separation between said plates and said edge beams; and said resilient members and said connectors forming at least one control chain connecting all said plates to one another and to said two edge beams.

Such a control device may comprise substantially only two different components, namely the resilient members and the connectors that are resistant to bending. The former are preferably each formed as a block of elastomer which is connected either directly or via anchoring parts to a plate or an edge beam and/or to the connector. The connectors are components that are subject to stress in tension and bending and are designed to ensure the necessary parallel guiding of the resilient members.

Mounting the control device is therefore very simple; owing to the fact that it can be secured to the underside of the plates or edge beams, there are no spatial problems with regard either to accommodating the components of the control device or to mounting them.

The connectors that are resistant to bending preferably consist of metal or a rigid plastics material. A suitable material for the resilient members is rubber or polyurethane.

Depending on the design of the bridging arrangement, two constructions of the control chains having different extreme rest positions are especially suitable.

In one construction the shear stress in each resilient member of a control chain is zero or virtually zero when the joint is closed and increases as the degree of opening of the joint increases.

In the second arrangement the shear stress in each resilient member of a control chain is zero or virtually zero when the joint is open to its maximum extent and increases as the joint closes.

In principle, however, it is also possible so to design the resilient members that their shear stress is zero or virtually zero in an intermediate position of the joint.

It is generally advantageous to provide at least two control chains at a distance from each other. Owing to the alternately acting shear forces, the plates are then held in position without torsion with respect to a vertical axis, that is to say parallel to one another and to the two edge beams fixed in the edges of the joint. To simplify the construction of the bridging arrangement, the edge beams can have the same design as the plates.

Preferably, an even number of control chains is provided, chains having maximum stress when the joint is closed and chains having maximum stress when the joint is open being arranged alternately. As a result of this alternating arrangement of the two different types of control chains, the construction of which is explained above, the control chains exert a constant bias on the plates in all positions of the joint since a decrease in the controlling forces exerted by one control chain is compensated for by an increase in the controlling forces exerted by the other control chain as the degree of opening of the joint varies.

The invention also provides a bridging arrangement for an expansion joint in a bridge or the like, comprising edge beams that define said expansion joint, cross-members bridging said expansion joint, one or more plates running parallel between said edge beams and mounted on said cross-members, and a control device according to the invention forming at least one control chain connecting all said plates to one another and to said two edge beams.

The invention further provides an assembly comprising two edge beams extending generally parallel to one another and spaced apart in a direction perpendicular to their length; at least one plate generally parallel to and between said edge beams; a plurality of resilient members, secured singly to each said edge beam and in pairs to each said plate; a plurality of connectors resistant to bending, each connecting a respective said resilient member of a said plate to a respective resilient member of an adjacent said plate or of a said edge beam; said resilient members and said connectors forming at least one control chain so connecting all said plates and said edge beams as to tend to maintain said plates at equal spacings from one another and from said edge beams, said resilient members being stressed primarily in shear, and said assembly being suitable for use as a bridging arrangement for an expansion joint in a bridge or the like.

Any of the optional and advantageous features disclosed for a control chain according to the invention may of course be applied, mutatis mutandis, to a bridging arrangement or an assembly according to the invention.

BRIEF DESCRIPTION OF THE DRAWINGS

FIG. 1 is a schematic cross-section through the control device taken in a vertical plane, FIG. 2 is a schematic bottom plan view of the device shown in FIG. 1;

FIGS. 3 and 4 show schematically a control element without shear deformation of its shear springs when the joint is closed and with corresponding shear deformation when the joint is open, and FIGS. 5 and 6 show schematically a control element without shear deformation of its shear springs when the joint is open and with shear deformation when the joint is closed.

DETAILED DESCRIPTION OF THE INVENTION

FIG. 1, shows, in cross-section, only two edge beams 1, 2 and two plates 3, 4 arranged between them of a bridging arrangement for a joint. Each of the edge beams 1 and 2 is securely fixed to part of the bridge 5 or 6 defining a respective edge of the joint, for example anchored in the concrete member of the edge portion 5 or 6 of the joint by anchoring parts (not shown). The control arrangement comprises control springs 7 and connectors 8 that are resistant to bending. There are secured to each connector 8 two control springs 7 which are connected either to different plates or to an edge beam and a plate. FIG. 1 shows the joint in the open position, the spacing between the plates 3 and 4 and between the edge beams 1 and 2 and the plates 4 and 3, respectively, being at the maximum. In this position of the joint, the shear springs 7 are deformed to the maximum degree, that is to say the control forces are at their greatest. The connectors 8 prevent any twisting of the shear springs 7 which comprise blocks of elastomer. These can be bonded directly to the undersides of the edge beams 1 and 2 and of the plates 3 and 4 or can be connected in any other manner to the connecting parts, for example via anchor parts lying between them. The springs 7 are connected to the connectors 8 that are resistant to bending in the same manner.

FIG. 2 shows the control device as shown in FIG. 1 in a view from below. It is possible to recognise the approximately rectangular-shaped connectors 8 and the shear springs 7 deformed beyond the transversly-extending edges of the connectors 8. In the device shown in FIGS. 1 and 2, the control chain comprises only three control elements, each comprising a connector 8 and two shear springs 7. As shown in FIGS. 3 and 4, the control elements are unstressed when the joint is closed, the shear springs then being substantially cuboidal, as shown in FIG. 3; when the joint is open they develop their maximum control force, corresponding to the deflection of the shear springs 7 shown in FIG. 4.

Referring to FIGS. 5 and 6, in a modified form of the device, of which only two plates 9 and 10 are shown, the plates shown in FIG. 5 are connected to a common connector 8 via shear springs 7 that are unstressed in the open position of the joint as shown in FIG. 5. Deflection of the shear springs 7, as shown in FIG. 6, resulting in corresponding control forces, is produced as the joint narrows, until in the closed position of the joint shown in FIG. 6 the control force is at its maximum.

It is to be understood that the form of the invention shown and described is to be taken as a preferred example of the same, and that various changes may be made without departing from the spirit and scope of the invention, which is determined solely by the following claims.

What is claimed is:

1. Apparatus for controlling the lateral spacing between adjoining members having upper and lower surfaces, comprising first flexible means deformable in shear extending transversely from a lower surface of one of the adjoining members;

second flexible means deformable in shear extending from a lower surface of another of the adjoining members spaced a distance from the first flexible means; and means having an upper surface and a first and second end for connnecting the extensions of the first flexible means at said first end and the second flexible means at said second end;

wherein the flexible means form a plurality of chains interlinking the adjoining members; and wherein at least one of the chains has maximum stress when the spacing between the lateral members is minimum and the spacing of the first and second flexible means is a first distance and said chain is positioned alternately with another of the chains which has minimum stress when the spacing between adjoining members is minimal and the spacing of the first and second flexible means is a second distance;

wherein said adjoining members have a lateral void therebetween and said flexible members are blocks of parallelopipedal elastomeric material.

2. Apparatus as defined in claim 1 wherein the elastomeric members are disposed so that the stress in the elastomeric members is minimal when the spacing between the adjoining members is minimum.

3. Apparatus as defined in claim 1 wherein the stress in the elastomeric members is minimum when the spacing between the lateral members is at an intermediate position.

4. Apparatus for controlling the lateral spacing between adjoining members having upper and lower surfaces, comprising first flexible means deformable in shear extending transversely from a lower surface of one of the adjoining members;

second flexible means deformable in shear extending from a lower surface of another of the adjoining members spaced a distance from the first flexible means; and means having an upper surface and a first and second end for connecting the extensions of the first flexible means at said first end and the and second flexible members;

wherein the flexible means form a plurality of chains interlinking the adjoining members; and wherein at least one of the chains has maximum stress when the spacing between the lateral members is minimum and the spacing of the first and second flexible means is a first distance and said chain is positioned alternately with another of the chains which has minimum stress when the spacing between adjoining members is minimal and the spacing of the first and second flexible means is a second distance;

wherein the flexible means interconnecting the lower surfaces of the adjoining members to the upper surface of the connecting means are disposed to exert a constant bias on the members in all positions of the spacing therebetween so that as the spacing between the adjoining members varies, a decrease in the pressure exerted on some of the flexible means is compensated by an increase in the pressure on another of the flexible members.

5. A device for controlling the spacing of parallel elements of a bridging arrangement for an expansion joint in a bridge or the like, said elements comprising two edge beams that define said expansion joint and at least one plate, cross members bridging said expansion joint, and one or more said plates running parallel between said edge beams and mounted on said cross-members, the device comprising:

a plurality of connectors that are resistant to bending having a first and second end;

a first and second plurality of resilient members, each secured at one end to a first and second one of said elements and, at the other end, to a first and second end of one of said connectors;

each connector and two of said resilient members securing two of said elements together, said resilient members deforming resiliently in shear in response to changes in the separation between said plates and said edge beams;

said resilient members and said connectors forming at least two control chains connecting all of said plates to one another and to two of said edge beams;

each element and connector having an upper and a lower surface and each resilient member being connected to an element lower surface and a connector upper surface such that each of said resilient members of at least one control chain is disposed a first distance to have zero or virually zero shear stress when said joint is closed and increase as the opening of said joint increases;

each of said resilient members of at least one other control chain being connected to an element lower surface and a connector upper surface such that each of said resilient members of said other control chain is disposed a second distance to have zero or virtually zero shear stress when said joint is open to the maximum and increases as said joint narrows; and wherein said control chains are spaced apart from one another in the parallel direction of said elements so that an even number of control chains having maximum stress when said joint is closed alternate with an equal number of control chains having maximum stress when said joint is opened.

6. A device according to claim 5, wherein said resilient members are formed as blocks of elastomer which are connected to said plates, said edge beams and said connectors.

7. A device according to claim 6, comprising anchoring parts that are vulcanised or cemented onto said blocks of elastomer and screws securing said anchoring parts to respective said edge beams, said plates, and said connectors.

* * * * *